US010072436B2

(12) United States Patent
Waters, Jr.

(10) Patent No.: US 10,072,436 B2
(45) Date of Patent: Sep. 11, 2018

(54) SELF-ACTUATING FLOOD GUARD

(71) Applicant: Floodbreak, LLC., Houston, TX (US)

(72) Inventor: Louis A. Waters, Jr., Bellaire, TX (US)

(73) Assignee: Floodbreak, L.L.C., Houston, TX (US)

( * ) Notice: Subject to any disclaimer, the term of this patent is extended or adjusted under 35 U.S.C. 154(b) by 379 days.

(21) Appl. No.: 14/889,036

(22) PCT Filed: May 9, 2014

(86) PCT No.: PCT/US2014/037552

§ 371 (c)(1),
(2) Date: Nov. 4, 2015

(87) PCT Pub. No.: WO2014/183070

PCT Pub. Date: Nov. 13, 2014

(65) Prior Publication Data

US 2016/0076268 A1 Mar. 17, 2016

Related U.S. Application Data

(60) Provisional application No. 61/821,366, filed on May 9, 2013.

(51) Int. Cl.
*E06B 11/00* (2006.01)
*E04H 9/14* (2006.01)
(Continued)

(52) U.S. Cl.
CPC ..... *E04H 9/145* (2013.01); *E04B 1/66* (2013.01); *E04B 1/7076* (2013.01); *E06B 9/04* (2013.01); *E06B 2009/007* (2013.01)

(58) Field of Classification Search
CPC ... E04H 9/145; E04H 9/14; E04B 1/66; E04B 1/6806; E02B 3/104; E02B 7/205; E02B 7/40; E02B 3/102; E02B 7/42; E02B 7/54; E02B 7/50; E02B 7/44; E06B 7/082; E06B 9/04; E06B 3/38; E06B 2009/007; E06B 5/003; E06B 5/00; E06B 9/00
(Continued)

(56) References Cited

U.S. PATENT DOCUMENTS 563,133 A 6/1896 Cabaret
6,623,209 B1 * 9/2003 Waters, Jr. ..... E02B 3/104 405/100

(Continued)

*Primary Examiner* — Chi Q Nguyen
(74) *Attorney, Agent, or Firm* — Tim L. Burgess

(57) ABSTRACT

A plurality of flood prevention units are vertically stacked one over another inside a frame mounted over ventilation opening on a wall. Each unit includes a buoyant gate pivotally mounted by one or more pivotation members about a horizontal axis transverse to sidewalls of the frame for pivotation of the gate on rise of water buoyantly lifting the gate rotationally upwardly between said sidewalls for engagement with an upper deck horizontally connecting the sidewalls. A limiter limits the extent of self-actuation rotation of the gate. The gates are open during non-flooding conditions, allowing ventilation through the building opening, and sequentially close from lowest to highest on rise of water activating each gate in order, allowing ventilation to continue until the highest gate is closed.

20 Claims, 10 Drawing Sheets

(51) Int. Cl.

| | |
|---|---|
| ***E06B 9/04*** | (2006.01) |
| ***E04B 1/66*** | (2006.01) |
| ***E04B 1/70*** | (2006.01) |
| *E06B 9/00* | (2006.01) |

(58) Field of Classification Search
USPC ..... 49/11, 10, 12, 21; 52/2.17, 2.14, 208, 52/573.1, 202, 203; 405/92, 87, 96, 99
See application file for complete search history.

(56) References Cited

U.S. PATENT DOCUMENTS

| | | | | |
|---|---|---|---|---|
| 8,366,348 | B2 * | 2/2013 | Morii | E02B 7/52 210/170.1 |
| 8,869,455 | B1 * | 10/2014 | McFall | E06B 9/02 49/466 |
| 9,267,322 | B2 * | 2/2016 | Inui | E06B 5/003 |
| 2009/0185864 | A1 | 7/2009 | Waters, Jr. | |
| 2012/0028564 | A1 * | 2/2012 | Kelly | E04B 1/7076 454/275 |
| 2012/0034032 | A1 | 2/2012 | Waters, Jr. | |
| 2012/0219360 | A1 * | 8/2012 | Morii | E02B 7/44 405/100 |
| 2014/0140770 | A1 * | 5/2014 | Nakayasu | E02B 7/44 405/107 |

* cited by examiner

SELF-ACTUATING FLOOD GUARD

CROSS-REFERENCE TO RELATED APPLICATIONS

This application claims the benefit of the filing date of U.S. Provisional Patent Application No. 61/821,366 filed May 9, 2013, the disclosures of which are incorporated by reference.

STATEMENT REGARDING FEDERALLY SPONSORED RESEARCH AND DEVELOPMENT

Not Applicable

BACKGROUND OF THE DISCLOSURE

Field of Disclosure

This invention relates to barriers for guarding against horizontal entry of floodwaters through vertical openings in buildings, especially tall ventilation openings.

Background

Floodwaters are a major source of property damage. On Oct. 29 and 30, 2012 tropical storm Sandy struck New York City, its suburbs, and Long Island. Supplemented by a high tide, the storm surge was approximately 14 feet above mean low tide, overtopping seawalls and bulkheads lining Manhattan and other waterfront boroughs, flooding buildings, subway and vehicle tunnels, damaging electrical equipment, costing at least 48 lives, and in effect shutting down the City. Damages and economic losses across New York were estimated to be at least $33 billion and in neighboring New Jersey, $36.8 billion.

Doors and other grade level vertical openings have been guarded from entrance of water by gates that are self-actuating. See U.S. Pat. No. 6,623,209, by the inventor of the invention described herein. These self-actuating gates should be taller when raised than the projected height of flood waters above sea level, typically taken as the height of flood waters based on 100-year storm data (a 100-year storm is defined as the storm with a 1% percent chance of occurring within a region in any one given year). For example, if the height for a 100-year storm is 10 feet above sea level and the street or sidewalk served by the exit/entrance of a building has a height above sea level of 5 feet, the exit/entrance is vulnerable to flood waters exceeding 5 feet above street level. The top of typical exit/entrances at street level is several feet above six feet, typically 10 feet, so the raised height of a self actuating flood gate of the type described in U.S. Pat. No. 6,623,209 guarding the exit/entrance would have to be at least 5 feet tall for the 100 year storm and at least 10 feet tall for complete protection from flood waters that could reach to as high as the top of the typical exit/entrances opening. Due to constraints inside or outside the exit/entrance of a building, for example, stairs climbing to the level of the exit/entrance, it may not be feasible to install a self-actuating flood gate of the type provided in U.S. Pat. No. 6,623,209 in part at least due to the size of the housing for the gate necessary to accommodate the height the gate would have when raised.

One victim of Sandy was buildings in lower Manhattan with tall vertical louvered ventilation openings in the sides of the buildings starting well above the street level fronting the buildings. The grade of the street level for these victims was 6.6 feet above sea level. The bottoms of the ventilation openings were at least about 20 feet above sea level, yet floodwaters from Sandy scaled higher than the bottom of the ventilation openings and penetrated the interior of the buildings. Certainly in the case of ventilation openings high above street level a housing for a self-actuating flood gate of the type provided in U.S. Pat. No. 6,623,209 installed at grade level and a 20 foot tall flood gate normally would not be practicable.

The present invention provides a self-actuating gate that overcomes these constraint limitations.

BRIEF DESCRIPTION OF THE DRAWINGS

In the following detailed description of exemplary embodiments, reference is made to the accompanying drawings, which form a part hereof and in which are shown by way of illustration examples of exemplary embodiments with which the invention may be practiced. In the drawings and descriptions, like or corresponding parts are marked throughout the specification and drawings with the same reference numerals. The drawings are not necessarily to scale. Certain features of the invention may be shown exaggerated in scale or in somewhat schematic form and some details of conventional elements may not be shown in the interest of clarity and conciseness. Referring to the drawings.

DETAILED DESCRIPTION OF EMBODIMENTS

Figure 1:
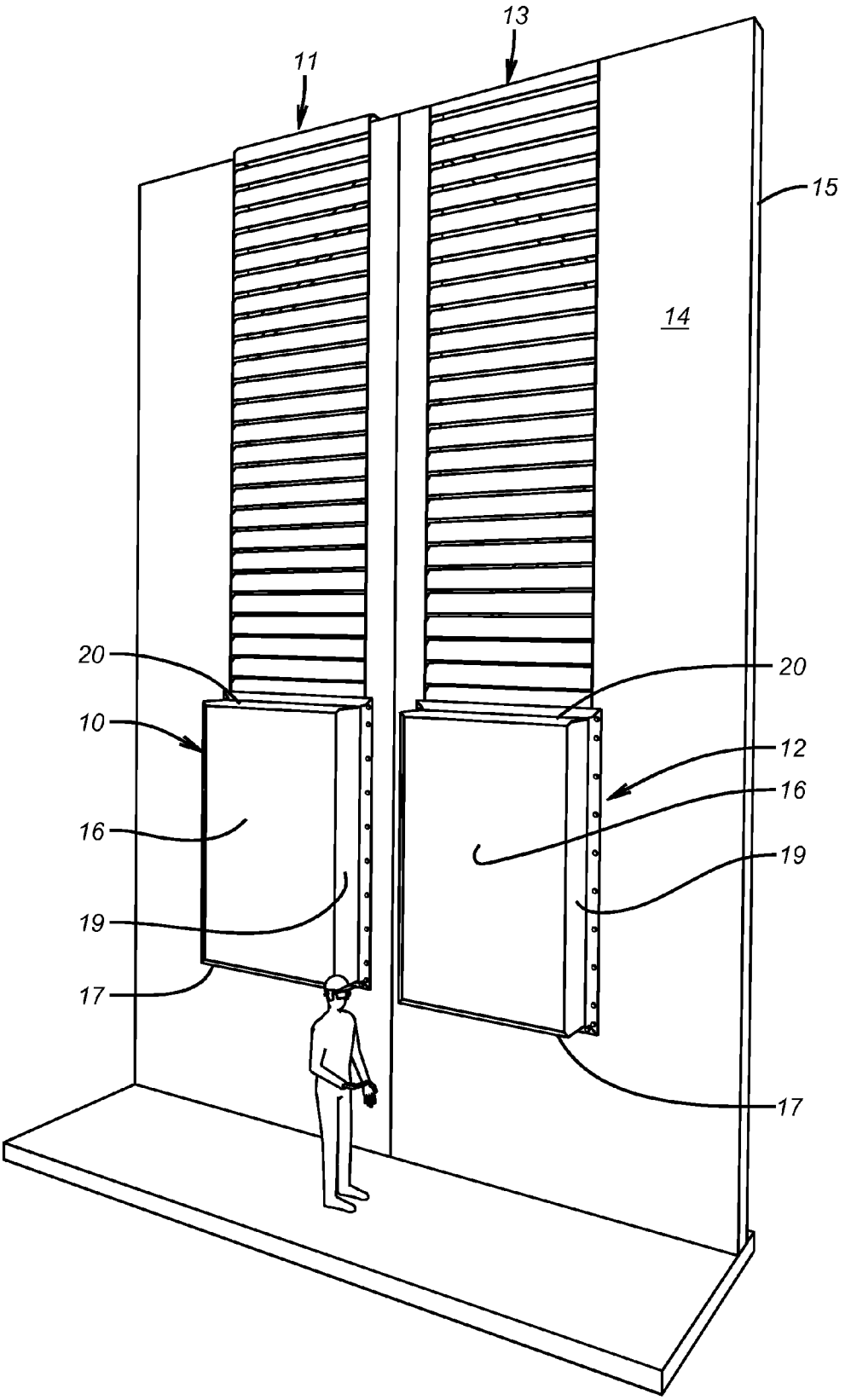
FIG. 1 is a perspective view of exemplary embodiment of a pair of shallow self-actuating flood barrier assemblies of the invention protecting a pair of tall vertical louvered ventilation openings in the side of a building.

Specific details described herein, including what is stated in the Abstract, are in every case a non-limiting description and exemplification of embodiments representing concrete ways in which the concepts of the invention may be practiced. Any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments that may or may not be given therewith or elsewhere in the specification and all such embodiments are intended to be included within the scope of that term or terms. The examples serve to teach one skilled in the art to employ the present invention in virtually any appropriately detailed system, structure or manner consistent with those concepts. Language designating such nonlimiting examples and illustrations includes, but is not limited to: "for example," "for instance," "e.g.," "in an embodiment." Reference throughout this specification to "an exemplary embodiment" means that a particular feature, structure, or characteristic described in connection with the embodiment is included in at least one exemplary embodiment of the present invention. Thus, the appearances of the phrase "in an exemplary embodiment" or similar expression in various places throughout this specification are not necessarily all referring to the same embodiment. Further, the particular features, structures, or characteristics may be combined in any suitable manner in one or more embodiments. Various changes and alternatives to the specific described embodiments and the details of those embodiments may be made within the scope of the invention. One or more of the elements depicted in the drawings can also be implemented in a more separated or integrated manner, or even removed or rendered as inoperable in certain cases, as is useful in accordance with a particular application. Because many varying and different embodiments may be made within the scope of the inventive concepts herein described and in the exemplary embodiments herein detailed, it is to be understood that the details herein are to be interpreted as illustrative and not as limiting the invention to that which is illustrated and described herein.

The various directions such as "upper," "lower," "back," "front," "transverse," "perpendicular", "vertical", "horizontal," "length," "height", "width," "laterally", "proximal", "distal" and so forth used in the detailed description of exemplary embodiments are made only for easier explanation in conjunction with the drawings. The components may be oriented differently while performing the same function and accomplishing the same result as the exemplary embodiments herein detailed embody the concepts of the invention, and such terminologies are not to be understood as limiting the concepts which the embodiments exemplify.

As used herein, the terms "comprises," "comprising," "includes," "including," "has," "having" or any other variation thereof, are intended to cover a non-exclusive inclusion. For example, apparatus that comprises a list of elements is not necessarily limited to only those elements but may include other elements not expressly listed or inherent to such apparatus. As used herein, the use of the word "a" or "an" when used in conjunction with the term "comprising" (or the synonymous "having" or "including" or variants of the same) in the claims and/or the specification may mean "one," but it is also consistent with the meaning of "one or more," "at least one," and "one or more than one." Further, unless expressly stated to the contrary, "or" refers to an inclusive or and not to an exclusive or. That is, unless otherwise indicated, the term "or" is generally intended to mean "and/or". For example, a condition A or B is satisfied by any one of the following: A is true (or present) and B is false (or not present), A is false (or not present) and B is true (or present), and both A and B are true (or present). In addition, as used herein, the phrase "connection to" or "connected to" means joined to, either directly or through intermediate components.

Embodiments of the invention comprise a shallow self-actuating flood barrier assembly responsive to rising water for preventing entrance of flood waters though an opening in a wall, for example, without limitation, a ventilation opening in a side of a building. In an embodiment, the assembly includes a frame comprising a first sidewall and a second sidewall for mounting adjacent opposite sides of the opening to project transversely outwardly from the wall. The assembly further comprises a plurality of flood prevention units vertically stacked one over another inside the sidewalls. Each unit includes a deck horizontally connecting the sidewalls and a buoyant gate horizontally disposed between the sidewalls below the deck. The gate is disposed in a plane oriented from substantially horizontal to less than vertical in the absence of a self-actuating force, e.g., rising water. Each gate has an upper surface, lateral sides, and front and rear ends. The rear end of each gate is pivotally mounted about a horizontal axis transverse to the sidewalls by one or more pivotation members. Each pivotation member comprises a stationary member on a support connected to the frame and a moveable member moveably joined to the stationary member for pivotation of the gate rotationally upwardly about its horizontal axis between the sidewalls for engagement with the deck on rise of water buoyantly lifting the gate. A limiter limits the extent of self actuated rotation of the gate. In an embodiment, the limiter comprises a seat against which the gate is halted from further rotation. In another embodiment, the limiter comprises a collapsible restraint one end of which is anchored to the frame below the upper surface of said gate and the other end of which is connected to the gate. For example, the restraint can be a cable, suitably of stainless steel, or can be one or more foldable arms. In another embodiment, the limiter comprises a configuration of the pivotation members such that the moveable member is prevented by the stationary member from rotation past a predetermined angle.

In an embodiment, the gate of each of the plurality of units except a vertically lowermost unit is vertically spaced at its rear end from the rear end of the gate of a next lower unit by at least the sum of a vertical dimension of the deck and a vertical height of the maximum rise of the gate of such next lower unit about the horizontal axis on which the next lower unit can rotate upwardly.

In an embodiment, the assembly includes sealing lip gaskets arranged on the lateral sides and front of the gates to sealing wipe respectively the sidewalls and the deck on rise of the gate and also comprises a sealing strip gasket spanning over the pivotation members from a rearward portion of the gate.

In an embodiment, the deck is located at a rear portion of the sidewalls and the maximum rise of the gate is vertical or within a predetermined range of degrees from vertical wherein the lip gaskets on the front of the gate provide a seal. If less than vertical, this provides for a gate that automatically re-opens by gravity after flood waters recede. The gate can go past vertical a few degrees so long as it can still seal. This would keep the gate closed after the flood waters recede, allowing workers to clear the area visually before lowering the gates to re-open a protected vent.

In an embodiment, the deck is located at a rear portion of the sidewalls, the maximum rise of the gate is vertical, and the stationary member includes horizontally spaced vertical flat top stands mounting between them a proximal portion of the moveable member on a fulcrum pin carried in the horizontal axis by the stands, and the moveable member distally past the stands has outwardly stepped flat shoulders to engage the flat tops of the stands and prevent further rotation when the moveable member is rotated to vertical about the axis.

In an embodiment, the gate of each of the plurality of units except a vertically lowermost unit is vertically spaced at its rear end from the rear end of the gate of a next lower unit by at least the sum of a vertical dimension of the deck and a distance between the front and rear ends of the next lower gate. In an embodiment, a depth of a unit is substantially the same as a height of the unit. In an embodiment, all units have the same depth and height.

In an embodiment, the frame also comprises a horizontal box tray under each gate and, except for the lowermost unit, above the deck of the next lower unit of the assembly. The tray stiffens the supporting structure for the gate and deck of each unit of the assembly. In an embodiment, the tray includes a plurality of apertures for vertical passage of water. In an embodiment, the units above the lowermost unit further include a plurality of bars in and suitably connected to the trays under the gates to hold the gates off the trays. In an embodiment, the deck is located at a rear portion of the sidewalls and at corners connecting to the sidewalls arcuately blends into the sidewalls and the front and its lateral ends of the gates arcuately meet for mating acceptance inside the arcuate corners of the deck.

In an embodiment, the frame further includes a top cross member and a bottom cross member each connected to the sidewalls at respectively the top and bottom extents of the sidewalls, and at least the bottom cross member and the sidewalls include an external flange having apertures for bolts for bolting the assembly to the building over the opening.

In an embodiment, a meshwork covers the frame distal to the opening to prevent access to the flood prevention structure while allowing ventilation though the assembly when the gates are not raised.

Referring now to FIG. 1, in an embodiment, a pair of shallow self-actuating flood barrier assemblies 10, 12 covers a lower extent of a pair of tall vertical louvered ventilation openings 11, 13 in a wall 14 of a building 15. A meshwork 16 covers the front of the assemblies to prevent access to the flood barrier structure behind the meshwork while allowing ventilation though the assembly to and from the ventilation openings in the absence of a flooding event.

Figure 2:
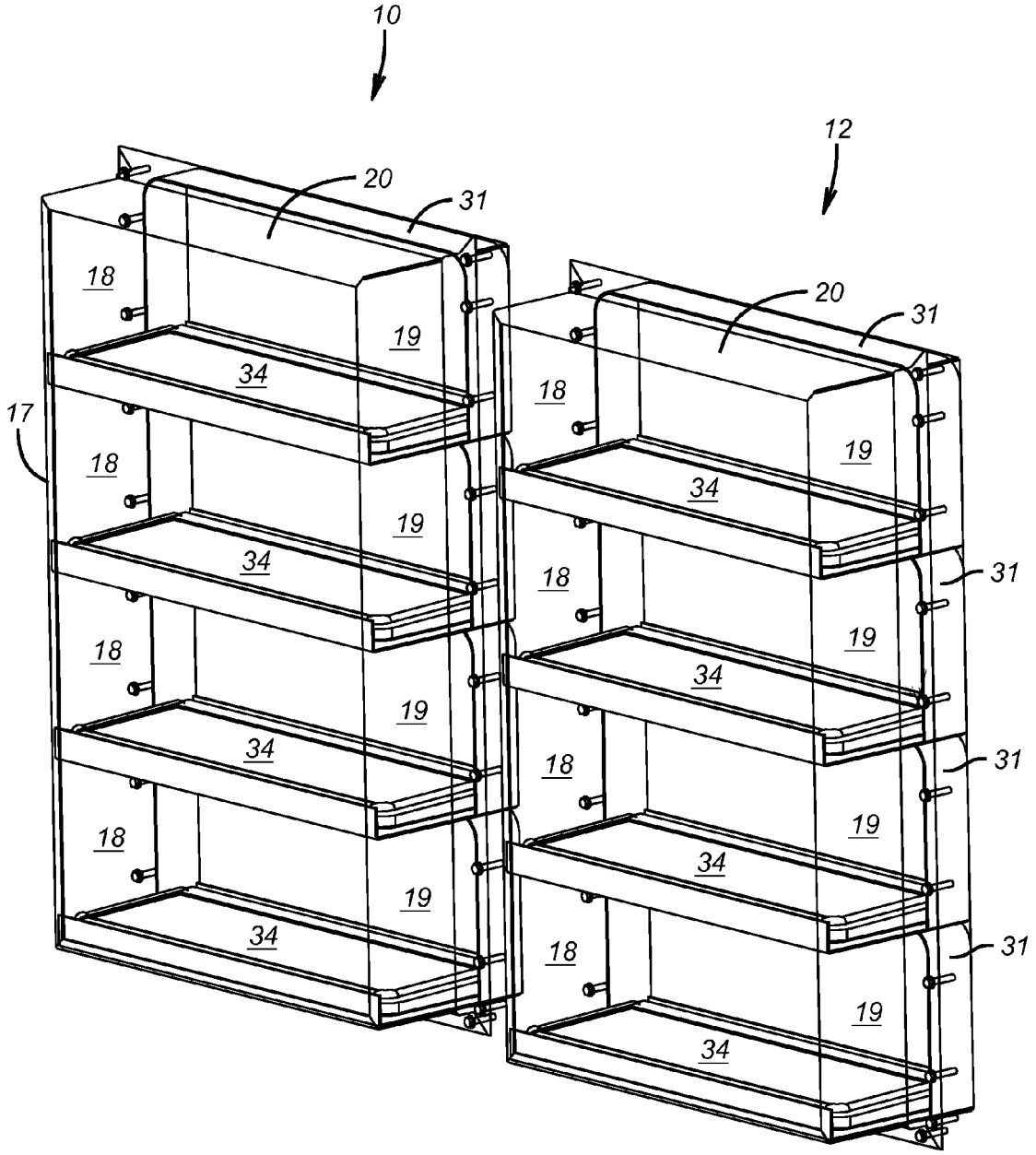
FIG. 2 is a perspective view of the pair of embodiments of FIG. 1 with front coverings removed to reveal the interior of the embodiment.
Figure 3:
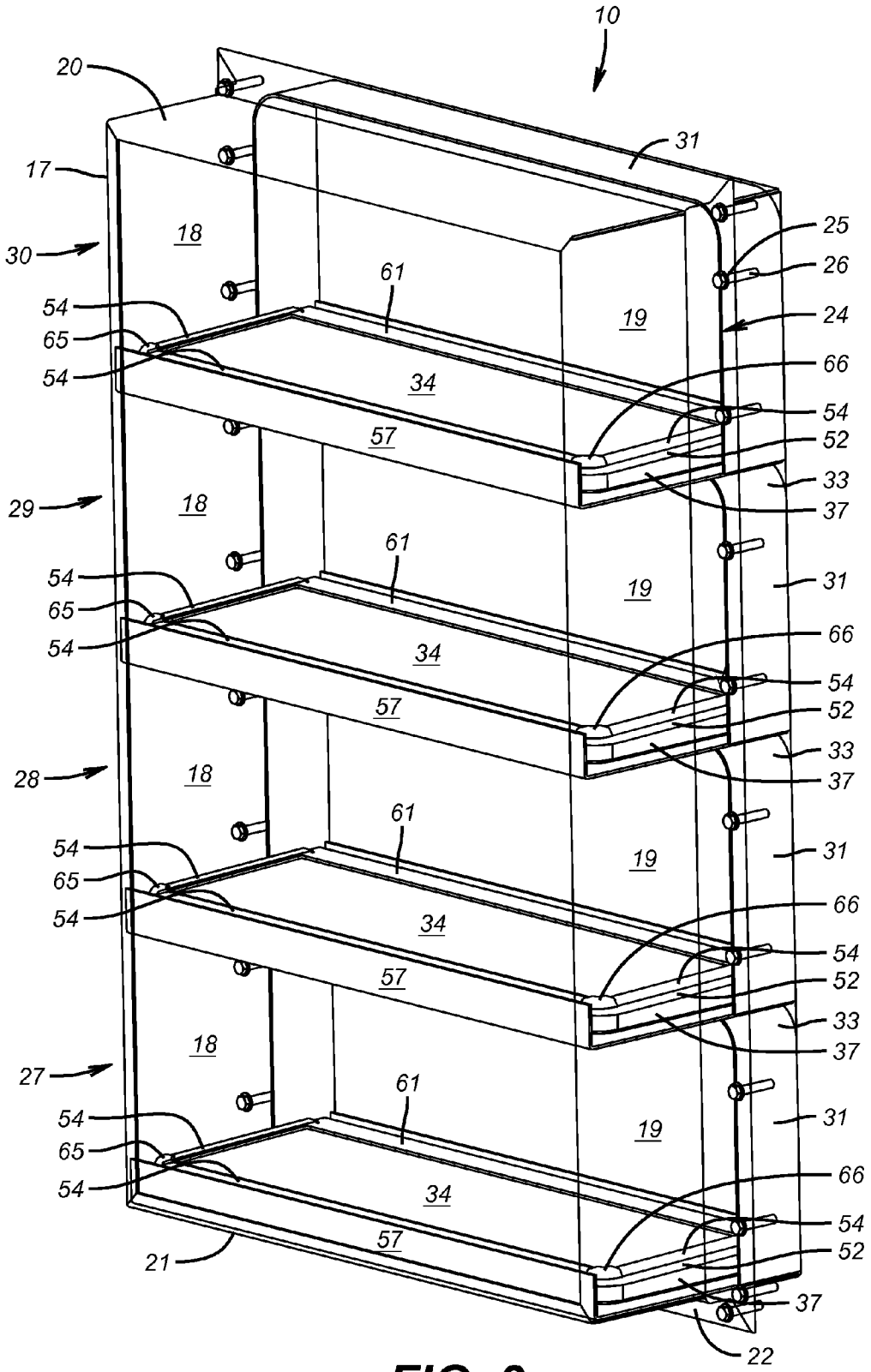
FIG. 3 is a larger view of one of the pair of embodiments of FIG. 2.
Figure 4:
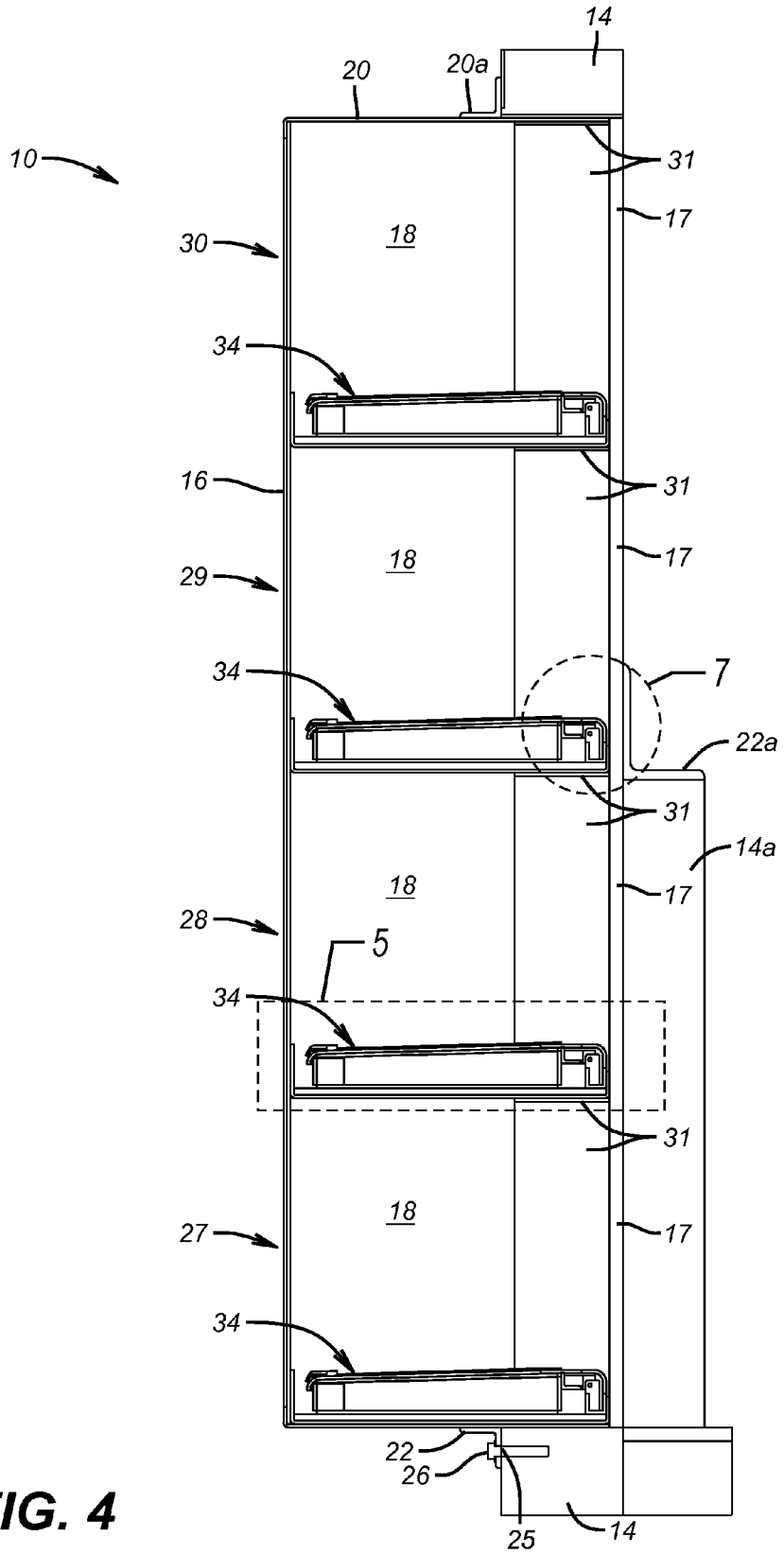
FIG. 4 is a side sectional view of FIG. 3 along the lines 4-4 of FIG. 3.
Figure 5:
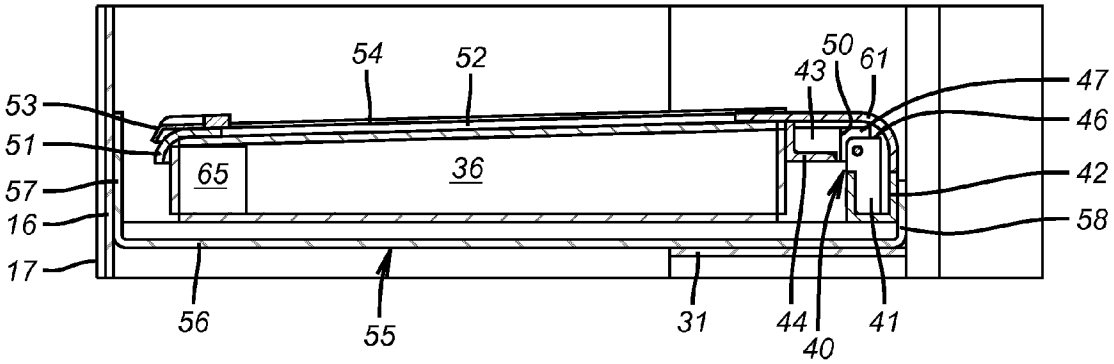
FIG. 5 is an enlargement of the portion of FIG. 4 bounded by the rectangular dashed lines indicated by the reference numeral 5.

Referring also to FIGS. 2-4, the assemblies of the embodiments of FIG. 1 comprise a frame 17 including a first sidewall 18 and a second sidewall 19 for mounting adjacent opposites sides of the openings 11, 13. In this embodiment, openings 11, 13 are vertical and sidewalls 18, 19 are vertical and parallel to each other. Sidewalls 18, 19 project transversely outwardly from wall 14, as shown in FIG. 1. Frame 17 further includes a top cross member 20 and a bottom cross member 21 each connected to sidewalls 18, 19 at respectively the top and bottom extents of the sidewalls. Bottom cross member 21 and sidewalls 18, 19 include external flanges respectively 22, 23, 24 having holes 25 for bolts 26 for bolting the assembly to wall 14 over the lower extent of openings 11, 13. As depicted in FIG. 4, top cross member 20 provides a brace 20*a* against wall member 14 and an additional flange 22*a* connected to frame 17 back braces frame 17 of assembly 10 against a wall support 14*a*.

Continuing particularly with reference to FIGS. 2-4, an assembly embodiment of the invention includes a plurality of flood prevention units 27, 28, 29 and 30 vertically stacked one over another inside sidewalls 18, 19. Unit 28 is stacked over unit 27, unit 29 is stacked over unit 28 and unit 30 is stacked over unit 29. Each unit 27, 28, 29 and 30 includes a deck 31 located at a rear portion of sidewalls 18, 19 that horizontally spans across a rear portion of the sidewalls and is connected to the sidewalls at corners at the rear of a unit 27, 28, 29 or 30. In an embodiment (see especially FIGS. 2, 3 and 6), deck 31 is a band horizontally connected to sidewalls 18, 19 at radiused corners 32, 33 arcuately blended into the sidewalls. In an alternative joinder of radiused cornered band 31 with sidewalls 18, 19, deck 31 may be an inverted U shaped band 31 butt joined to sidewalls 18, 19. FIGS. 2-5 and 10-13 show a vertical line at the forward extend of band 31. This indicates the forward extent of deck band 31 whether a butt joint or a blend joinder to sidewalls 18, 19.

Each unit 27, 28, 29 and 30 further comprises buoyant gate 34 horizontally disposed between sidewalls 18, 19 below deck 31. The gate comprises buoyant material, for example, it may comprise a plurality of sealed tubes arranged side by side (a sealed tube is shown in the section views of the drawings), or a honeycomb core structure sealingly arranged between two rigid panels.

Figure 14:
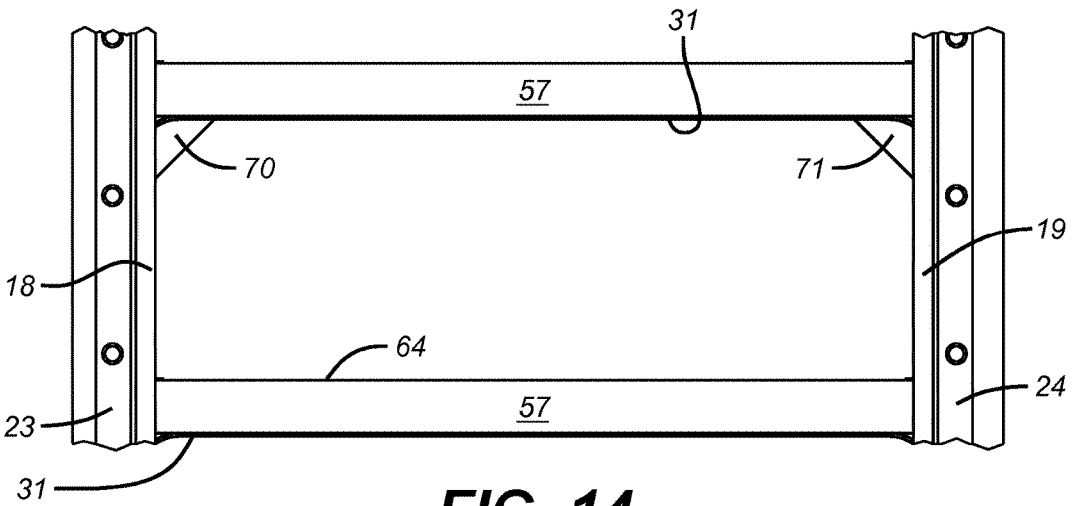
FIG. 14 is the same view as FIG. 6 in an embodiment of an assembly that includes a seat for limiting self actuated rotation of a gate of a unit of the assembly.
Figure 15:
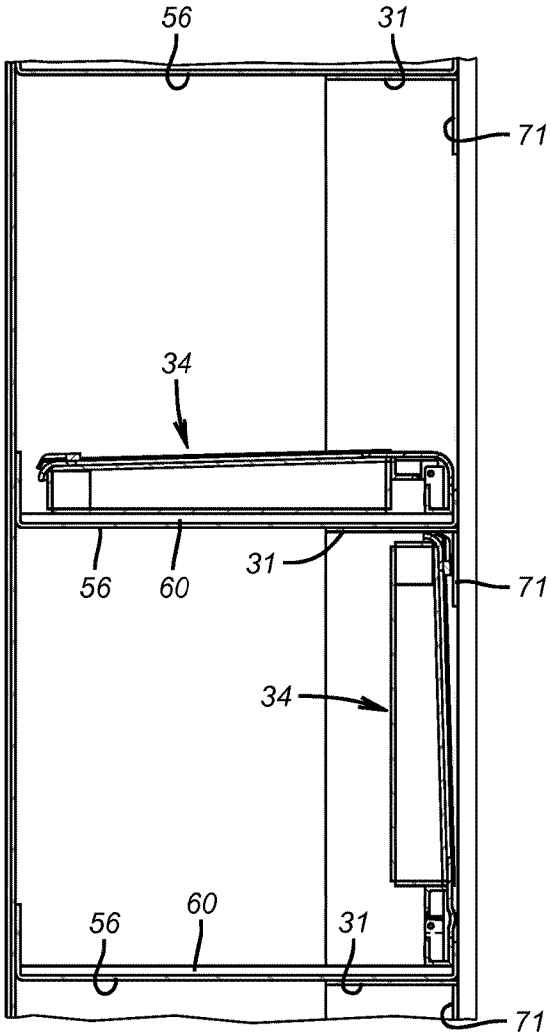
FIG. 15 is a side sectional view of two units of an embodiment of an assembly having the seat shown in FIG. 14.

In an embodiment as depicted in FIGS. 2-5 in particular, gate 34 is oriented in a substantially horizontal plane in the absence of a self-actuating force. Gate 34 has an upper surface 35, lateral sides 36, 37 and front and rear ends, respectively 38, 39. As best seen in FIGS. 5, 7-9, rear end 39 of each gate 34 is pivotally mounted about a horizontal axis transverse to sidewalls 18, 19 by one or more pivotation members 40. Each pivotation member 40 comprises a stationary member 41 on a support 42 connected to frame 17 and a moveable member 43 connected to the rear end 39 of gate 34 by flange 44 fastened to gate 34. Moveable member 43 is moveably joined to stationary member 41 for pivotation of gate 34 rotationally upwardly about its horizontal axis between sidewalls 18, 19 for engagement to the front end 38 with deck 31 on rise of water buoyantly lifting the gate. In the embodiments of FIGS. 2-13, as best seen in FIGS. 5 and 7-9, a limiter for limiting the extent of self actuated rotation of the gate is a configuration of the stationary and moveable members of the pivotation members; stationary member 41 includes horizontally spaced vertical flat top stands 45, 46 mounting between them a proximal portion 47 of moveable member 43 on a fulcrum pin 48 carried in the horizontal axis between stands 45, 46. Moveable member 43 has outwardly stepped flat shoulders 49, 50 distally past stands 45, 46 to engage the flat tops of stands 45, 46 and prevent further rotation of gate 34 when moveable member 43 is rotated to vertical about the horizontal axis in which pin 44 is carried. FIGS. 14 and 15 show another embodiment of a limiter for limiting the extent of self actuated rotation of the gate. The limiter comprises tabs 70, 71 inset into radiused corners 32, 33 of deck 31 providing a seat against which gate 34 is halted from further rotation, as seen in FIG. 15.

Figure 16:
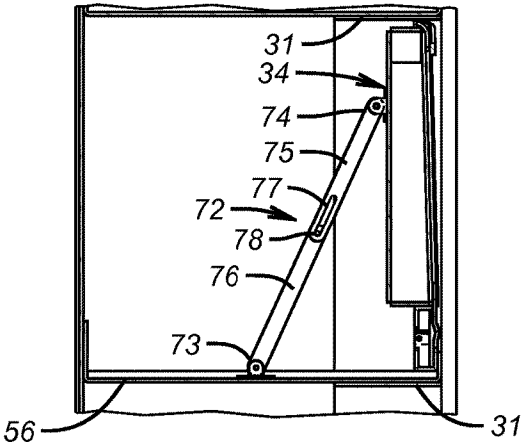
FIG. 16 is a side sectional view of a unit of an assembly embodiment that includes a folding arm for limiting self actuated rotation of a gate of a unit of the assembly.
Figure 18:
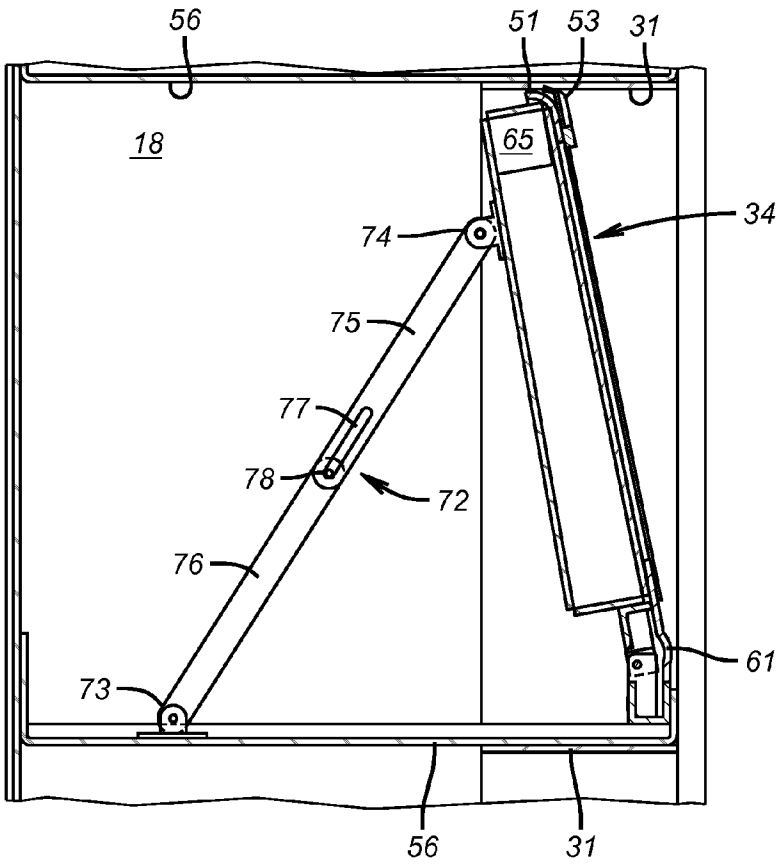
FIGS. 17 and 18 are side sectional views of actuation of the folding arm limiter of FIG. 16.
Figure 17:
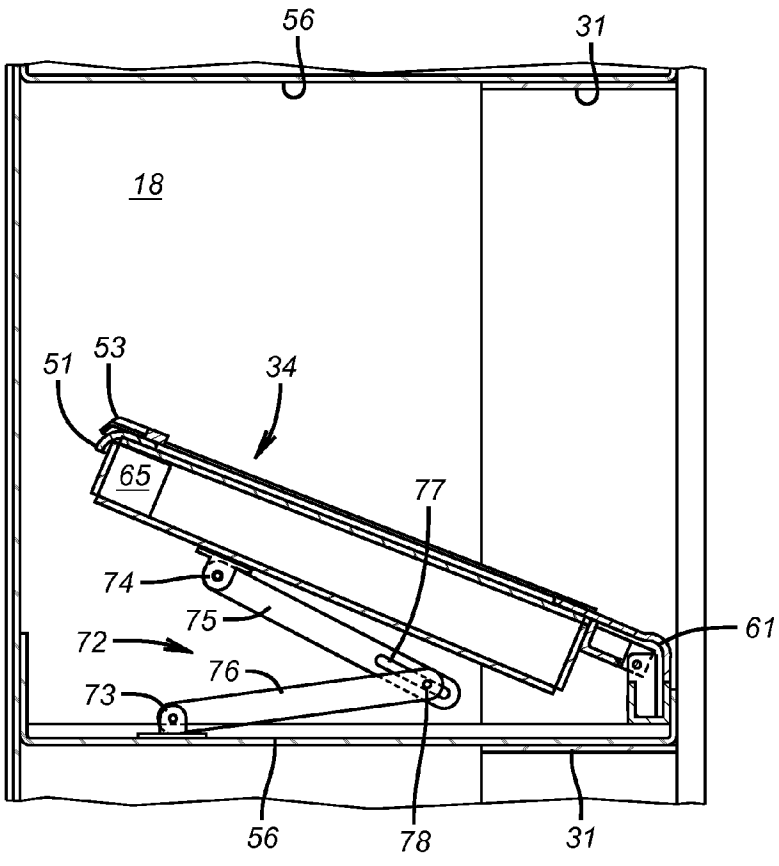

FIG. 16 shows another embodiment of a limiter for limiting the extent of self actuated rotation of the gate. The limiter comprises at least one foldable arm 72 one end of 73 which is pivotably anchored to the frame (tray 55, see below) below gate 34 and the other end 74 of which is pivotally connected to the underside of gate 34. Arm 75 comprises an upper part 75 and a lower part 76. Upper part 75 has a slotted portion 77 that slidingly pivots on a pin 78. As depicted in FIG. 17 and FIG. 18, on rise of water (water not shown for clarity), gate 34 buoys upwardly unfolding arm 72 and limiting the travel of gate 34 upward when arm 72 is fully extended. As also shown in FIG. 18, arm 72 may be arranged such that the maximum rise of gate 34 is not quite vertical but is within or within a predetermined range of degrees less than vertical where the lip gaskets 51, 53 on the front of gate 34 provide a seal with desk 31. This provides for a gate that automatically re-opens by gravity after flood waters recede.

The front end 38 and the lateral sides 36, 37 of a gate 34 arcuately meet at corners 65, 66 for mating acceptance inside the arcuately radiused corners 32, 33 of deck 31. Sealing lip gaskets 51 and 52 arranged respectively on front end 38 and the lateral sides 36, 37 of the gates 34 supplemented by front end lip gasket 53 sealing wipe sidewalls 18, 19 (gasket 52) and deck 31 (gaskets 51 and 53) on rise of gate 34. Gaskets 51-53 are attached to the upper surface 35 at front end 38 and the lateral sides 36, 37 of gate 34 by fastener strips 54.

In the embodiments shown in FIGS. 1-18, frame 17 of units 27, 28, 29 and 30 further comprises a horizontal tray 55 under gate 34, and in the case of all but the lowermost unit 27, above deck 31 of the next lower unit of the assembly. Thus tray 55 of unit 28 is above deck 31 of the next lower unit 27, tray 55 of unit 29 is above deck 31 of the next lower unit 28, and tray 55 of unit 30 is above deck 31 of the next lower unit 29. Tray 55 comprises a floor plate 56, a front plate 57 and a back plate 58. Back plate 58 and front plate 57 are laterally joined to frame 17. Tray 55 stiffens the structure of each unit and includes a plurality of apertures 59 in floor plate 56 for vertical passage of water, either percolating upwardly from below on rise of water above the next lower unit before rising water exceeds the height of front plate 57, or in the case of units 28-30 above the lowermost unit, draining downward to the next lower unit, and in the case of the lowermost unit 27, draining the lowermost unit of the assembly.

Units 27-30 suitably further include a plurality of bars 60 in the trays, suitably fixed in place, under the gates to support the gates above floor plate 56 so water can freely percolate upward under the gates to buoyant rotationally lift the gates 34 up out of the trays.

In another embodiment, a tray is not necessary as gate 34 may be maintained at rest in a plane oriented from substantially horizontal to less than vertical in the absence of a self-actuating force by horizontal rods connecting to sidewalls 18, 19 positioned at a level supporting the gates from below in a plane from substantially horizontal to less than vertical. Rising water will buoyantly and hydrostatically raise the gates as the water climbs under the gates. Either embodiments that do or do not have stiffening trays are within the scope of the invention.

A sealing strip gasket 61 spans over pivotation members 41, 43 from rear end 39 of gate 34 for sealing against flow under rear end 39 of gate 34. In an embodiment in which a unit includes a tray 55, a sealing strip 61 seals against water penetration between tray 55 and rear end 39 of a gate 34. In an embodiment in which a unit does not include a tray 55, a sealing strip 61 seals against water penetration between rear end 39 of a gate 34 and the deck 31 of the next lower unit except in the case of unit 27, where sealing is between the rear end 39 of gate 34 and frame 17.

Gates 34 of each of the plurality of units 28, 29, 30 above the vertically lowermost unit 27 are vertically spaced at their rear end 39 from the rear end 39 of the gate of a next lower unit by at least the sum of a vertical dimension of a horizontal portion of the deck 31 and a distance between the front and rear ends 38, 39 of the next lower gate 34. Thus in the embodiments of FIGS. 1-18, rear end 39 of gate 34 of unit 28 is so spaced from rear end 39 of gate 34 of unit 27; rear end 39 of gate 34 of unit 29 is so spaced from rear end 39 of gate 34 of unit 28; and rear end 39 of gate 34 of unit 30 is so spaced from rear end 39 of gate 34 of unit 29.

In the embodiments of FIGS. 1-18, all units 27, 28, 29 and 30 have the same depth and height. In these embodiments, depth is the distance from frame back 62 to the frame front 63 which contains meshwork 16. In embodiments with trays 55, this is close to the dimension from back plate 58 to front plate 57 of tray 55. Height is the distance from the floor plate 56 of a unit to the floor plate 56 of the next higher unit. In an embodiment, the units are substantially square in side elevation or vertical section (front to back) as, for example, seen in FIG. 4.

Figure 6:
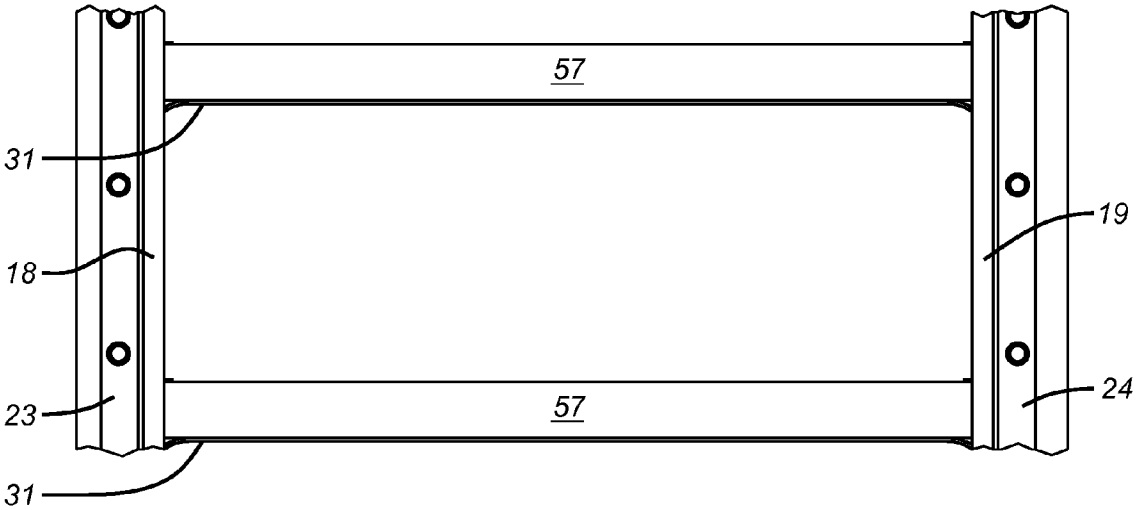
FIG. 6 is a front elevation view of the unit shown in section in FIG. 5.
Figure 8:
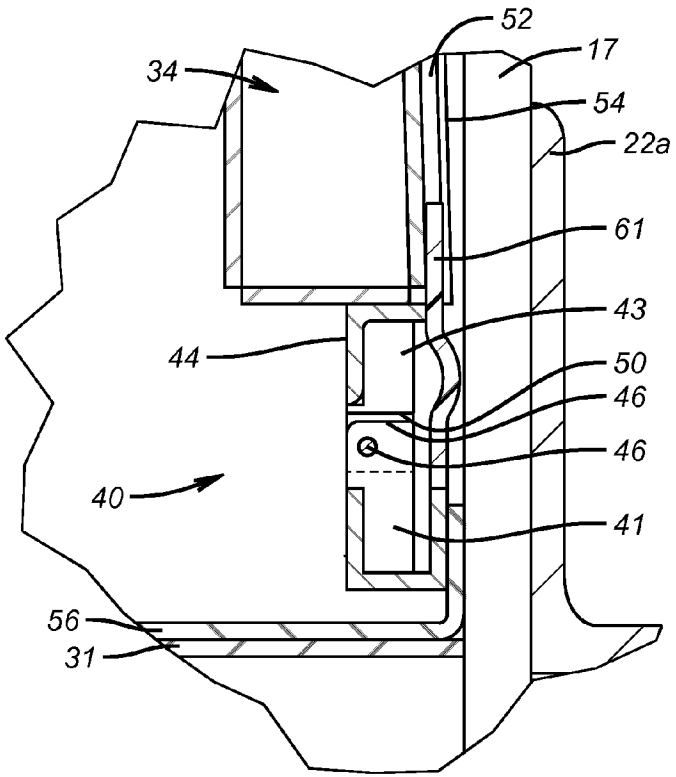
FIG. 8 is a similar view as FIG. 7 showing the pivotation members with the gate of a unit of the assembly in activated vertical position.
Figure 7:
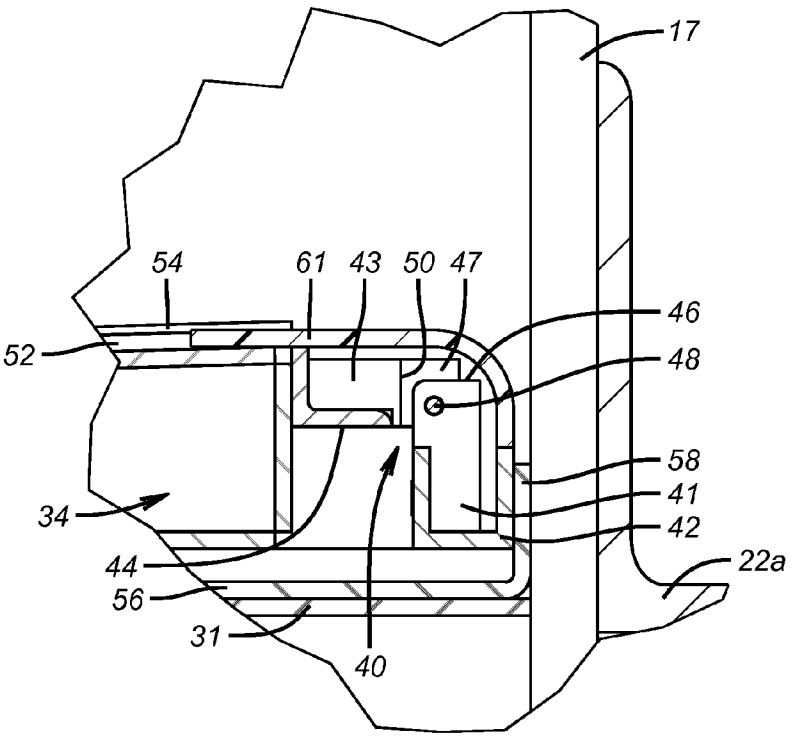
FIG. 7 is an enlargement of the portion of FIG. 4 bounded by the circular dashed lines indicated by the reference numeral 7 and illustrating the pivotation members with the gate of a unit of the assembly in non-activated horizontal position.
Figure 9:
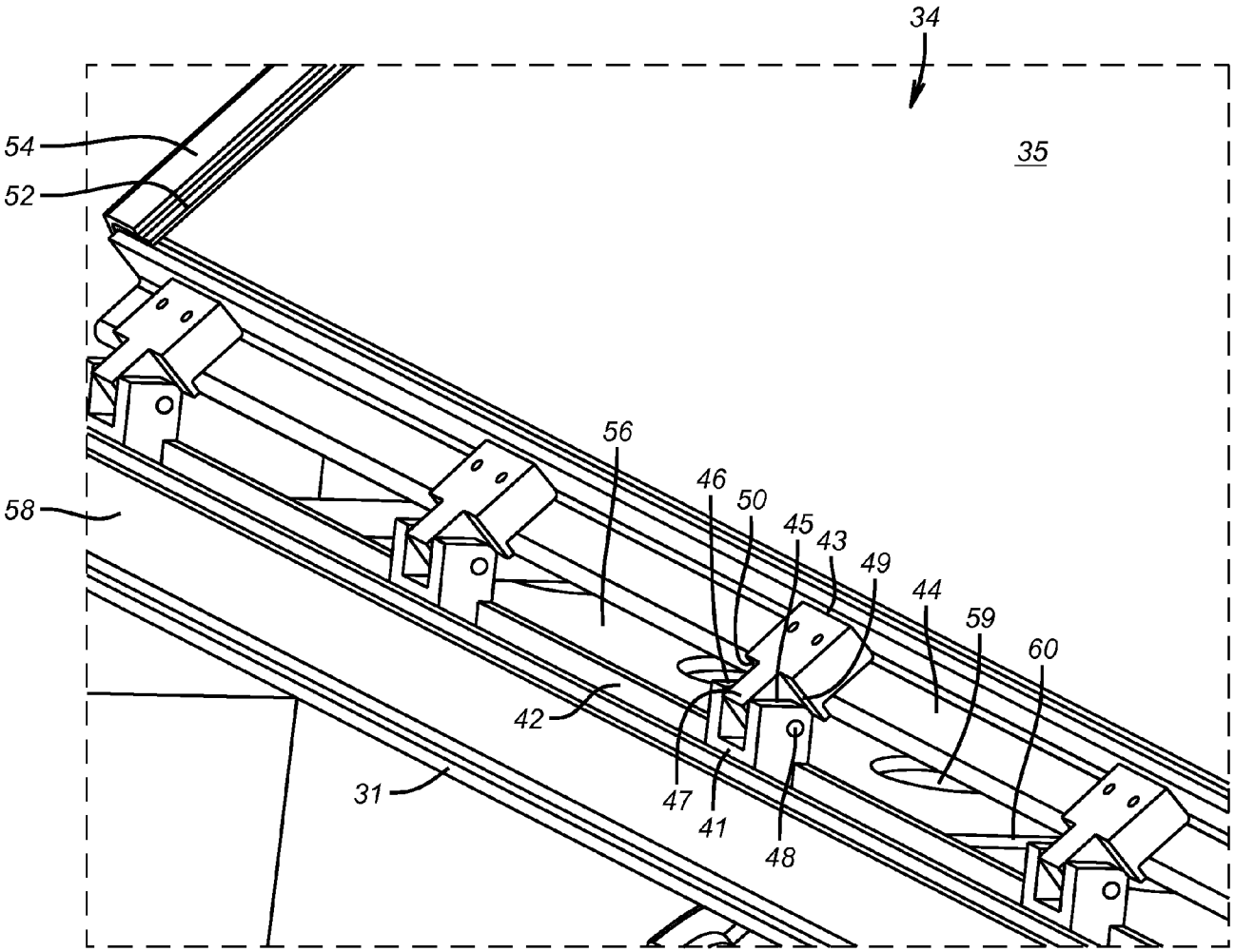
FIG. 9 is an perspective view of the rear of a unit of gate of a unit of the assembly with strip sealing gaskets removed showing a perspective detail of the pivotation members during rise of a gate of a unit of the assembly.
Figure 13:
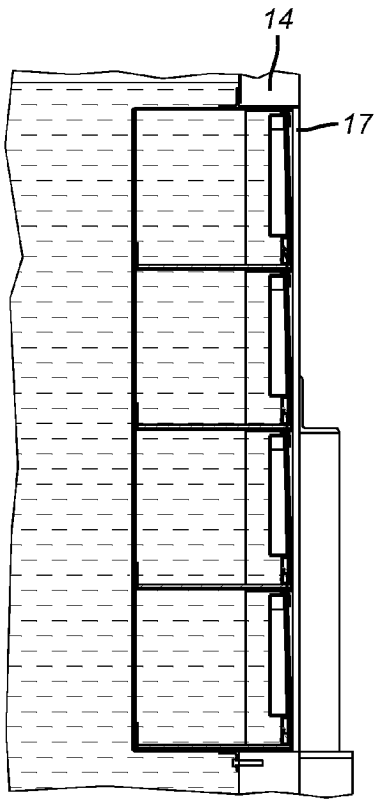
FIGS. 10-13 are side sectional views of the embodiment of FIG. 4 showing sequential elevation of flood gate units as water rises relative to the stack of units comprising the assembly shown in FIG. 4.
Figure 12:
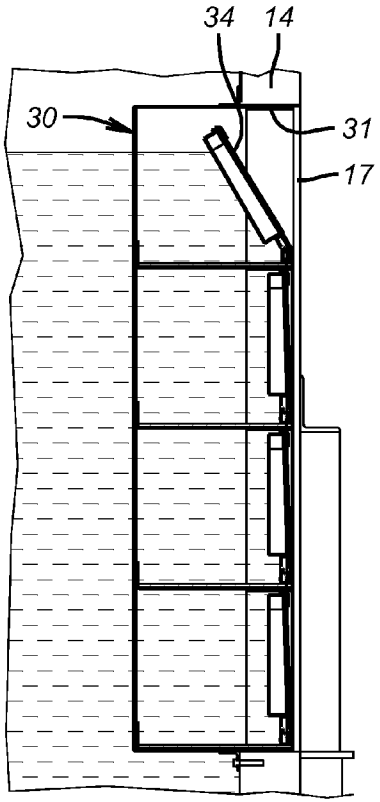
Figure 11:
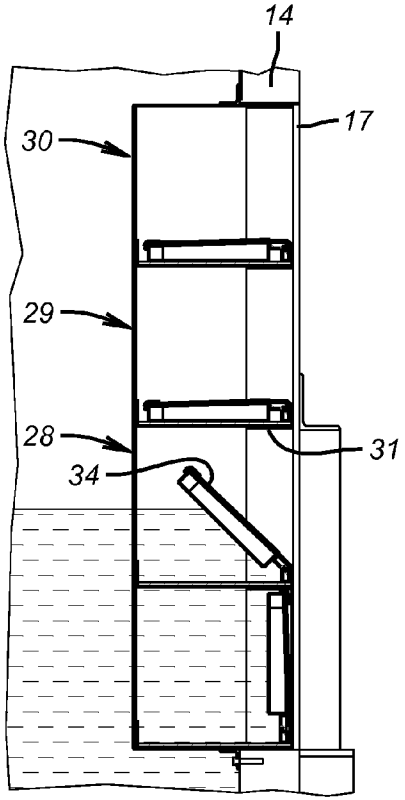
Figure 10:
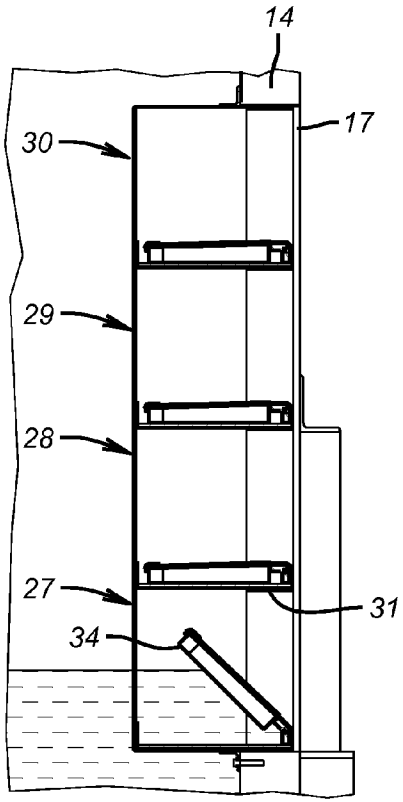

Referring to FIG. 6, the distance separating the top 64 of front plate 57 of a tray 55 to the bottom of the deck 31 of the same unit is the ventilation window through which air passes when a gate 34 is not self-activated by rising water, Referring to FIGS. 10-13, the operation of the embodiments of FIGS. 1-8 is depicted. As shown in FIG. 10, on rise of water percolating upward through apertures 59 of tray 55, gate 34 of lowermost flood prevention unit 27 of self-actuating flood barrier assembly 10 buoyantly lifting gate 34 rotationally upwardly between sidewalls 18, 19 about the horizontal axis defined by fulcrum pin 48 of pivotation members 40, 43. As gate 34 rises, water is prevented from escaping past gate 34 into opening 13 by lateral lip seals 52 sealingly wiping sidewalls 18, 19 and by strip gasket 61 sealing between rear end 39 of gate 34 and back plate 58 of tray 55. Initially a buoyant force equal to the weight of water displaced by the gate pushes the underside of the gate facing the water (the front face of the gate) rotationally upwardly about the pivotation axis against the force of gravity. As the gate inclines upwardly, the moments of the gravitational force normal to the upper surface 35 of the gate grow smaller and angular moments of the gravitational force develop and begin to orient in a direction approaching more parallel to the underside of the gate and against the pivotation axis. In consequence, the gravitational forces begin to exert less resistance to the buoyancy forces. As rise of the gate or gate unit continues, the hydrostatic pressure of the water pressing against the underside of the gate increases and contributes more and more to pushing against the underside of the gate as at the same time smaller and smaller moments of the gravity forces are acting against the upper surface of the gate and more and more moments of the gravitational force are borne by the pivotation members. Eventually the hydrostatic pressure of water pressing against the underside of the gate surpasses the buoyancy forces and overcomes the gravitational forces, and the gate is pushed to its final upright position at vertical or within a predetermined range of degrees from vertical wherein the lip gaskets on the front of the gate still provide a seal. In the vertical position, gravity forces are parallel to the underside of the gate and normal to the pivotation axis. The buoyancy forces are parallel to the underside of the gate, essentially normal to the pivotation axis and opposing the gravitational force. Hydrostatic pressure normal to the underside of the gate holds the gate upright As shown in FIG. 11, gate 34 of unit 27 has risen further on rise of water driven more by hydrostatic pressure pressing against the underside of gate 34 and has been swept across deck 31 with front end lip seal 51 and supplemental front end seal 53 sealingly engaging deck 31. Gate 34 has been prevented from rotating past vertical by seating of square shoulders 49, 50 of moveable member 43 on flat top stands 45, 46 of stationary member 41. Further rise of water is depicted in FIGS. 11 and 12 in which the function described for unit 27 is repeated in unit 28, and also for unit 29, and in FIG. 13, wherein all units 26-30 are self-activated, erect and guarding opening 13. FIGS. 14-18 show alternative embodiments for limiting the extent of rise of gate 34.

Thus there is provided a self-actuating flood barrier assembly unconstrained from installation by grade level structures and responsive to rising water for preventing entrance of flood waters though an opening in a wall. The assembly is mountable directly onto the protected wall. The assembly provides sequential operation of a plurality of higher and higher gates rather than one very tall gate, and provides a shallow unobtrusive profile on the exterior of a protected opening. Because the assembly permits air flow though it under normal non-flooding conditions, the assembly is especially useful for protecting ventilation openings where air passage through the opening is necessary under normal non-flooding conditions, and further, for ventilation openings, allows at least some ventilation to continue until the uppermost gate has fully closed.

Thus there is provided a method of guarding an opening, for example a ventilation opening, in a wall of a structure against entrance of floodwaters while maintaining ventilation during non-flooding conditions, comprising mounting a frame comprising a first sidewall and a parallel second sidewall adjacent opposite sides of the opening to project transversely outwardly from the wall, the frame supporting a plurality of flood prevention units vertically stacked one over another inside the sidewalls, each unit comprising (a) a deck connecting the sidewalls, and (b) a buoyant gate horizontally disposed between the sidewalls below the deck in a plane oriented from substantially horizontal to less than vertical in the absence of a self-actuating force, such gate having an upper surface, lateral sides, and front and rear ends, the rear end of each gate being pivotally mounted about a horizontal axis transverse to the sidewalls by one or more pivotation members, each the pivotation members comprising a stationary member on a frame support and a moveable member moveably joined to the stationary member for pivotation of the gate rotationally upwardly about its horizontal axis between the sidewalls for engagement with the deck on rise of water buoyantly lifting the gate, and a limiter for limiting the extent of self actuated rotation of the gate, wherein the gate of each of the plurality of units except a vertically lowermost unit is vertically spaced at its rear end from the rear end of the gate of a next lower unit by at least the sum of a vertical dimension of the deck and a vertical height of the maximum rise of the gate of such next lower unit about the horizontal axis on which the next lower unit can rotate upwardly.

It will be appreciated that one or more of the elements depicted in the figures can also be implemented in a more separated or integrated manner, or even removed or rendered as inoperable in certain cases, as is useful in accordance with a particular application. Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

The invention claimed is:

1. A shallow self-actuating flood barrier assembly responsive to rising water for preventing entrance of flood waters though a horizontal opening in an upright wall of a structure, comprising:

a) a frame comprising a first upright sidewall and a second upright sidewall for mounting adjacent opposite sides of said opening to project transversely outwardly from said wall, b) a plurality of flood prevention units vertically stacked one over another inside said sidewalls, each unit comprising:

i) a deck horizontally connecting said sidewalls, one deck for each unit ii) a buoyant gate horizontally disposed between said sidewalls below said deck of the unit in a plane oriented from substantially horizontal to less than vertical in absence of a self-actuating force, said gate having an upper surface, lateral sides, and front and rear ends, the rear end of each gate being pivotally mounted about a horizontal axis transverse to said sidewalls by one or more pivotation members, each said one or more pivotation members comprising a stationary member on a support connected to said frame and a moveable member moveably joined to said stationary member for pivotation of the gate rotationally upwardly about said horizontal axis between said sidewalls for engagement with said deck on rise of water buoyantly lifting the gate, iii) a sealing gasket arranged on the front end of the gate to sealingly wipe said deck of the unit on rise of said gate, and iv) a limiter for limiting an extent of self actuated rotation of said gate, the gate of each of said plurality of units except the vertically lowermost unit being vertically spaced at said rear end of the gate from the rear end of the gate of a next lower unit by at least a sum of vertical thickness dimension of said deck and a vertical height of maximum rise of the gate of said next lower unit about the horizontal axis on which said next lower unit can rotate upwardly.

2. The assembly of claim 1 further comprising sealing gaskets arranged on the lateral sides of the gates to sealingly wipe said sidewalls on rise of said gate and also comprising a sealing strip gasket spanning over said pivotation members from a rearward portion of the gate.

3. The assembly of claim 1 in which said deck is located at a rear portion of the sidewalls and wherein the maximum rise of the gate is vertical or within a predetermined range of degrees from vertical.

4. The assembly of claim 3, and wherein said pivotation members are configured such that said moveable member is prevented by said stationary member from rotation past a predetermined angle.

5. The assembly of claim 4 in which said stationary member includes horizontally spaced vertical flat top stands mounting between said stands a proximal portion of said moveable member on a fulcrum pin carried in said horizontal axis between said stands, and wherein said moveable member distally past said stands has outwardly stepped flat shoulders to engage said flat tops of said stands and prevent further rotation when the moveable member is rotated to vertical about said axis.

6. The assembly of claim 1 in which said flood prevention units vertically stacked one over another inside said sidewalls are stacked in an alignment such that an uppermost unit is and any intermediate units are entirely over a lowermost unit.

7. The assembly of claim 1 in which said limiter comprises a seat against which said gate is halted from further rotation.

8. The assembly of claim 1 in which said limiter comprises a collapsible restraint one end of which is anchored to said frame below said upper surface of said gate and the other end of which is connected to said gate.

9. The assembly of claim 1 in which a depth of a unit is substantially the same as a height of the unit.

10. The assembly of claim 9 in which all units have the same depth and height.

11. The assembly of claim 1 in which said frame further comprises a plurality of trays, one for each unit, under the gate of the unit and, except for the lowermost unit, above the deck of the next lower unit of the assembly, said trays each comprising a horizontal floor and upright front and back plates rising from the floor.

12. The assembly of claim 11 in which said tray includes a plurality of apertures for vertical passage of water.

13. The assembly of claim 11 in which said units further include a plurality of horizontal bars connected to the trays under the gates to support the gates off the trays.

14. The assembly of claim 13 in which the opening is a vertically tall ventilation opening.

15. The assembly of claim 1 in which said deck is located at a rear portion of the sidewalls and at corners connecting to said sidewalls arcuately blends into said sidewalls and wherein said front end and lateral sides of said gates arcuately meet for mating acceptance inside said arcuate corners of the deck.

16. The assembly of claim 1 in which said frame further includes a top cross member and a bottom cross member each connected to said sidewalls at respectively the top and bottom extents of the sidewalls, and wherein at least said bottom cross member and said sidewalls include an external flange having apertures for bolts for bolting the assembly to said wall over said opening.

17. The assembly of claim 16 further comprising a meshwork connected to the frame distal to said opening to prevent access to said flood prevention units while allowing ventilation though said assembly when the gates are not raised.

18. A method of guarding a horizontal ventilation opening in an upright wall of a structure against entrance of rising floodwaters while maintaining ventilation during non-flooding conditions, comprising mounting a frame, said frame comprising a first upright sidewall and a second upright sidewall adjacent opposite sides of said opening to project transversely outwardly from said wall, said frame supporting a plurality of flood prevention units vertically stacked one over another inside said sidewalls, each unit comprising:

a) a deck horizontally connecting said sidewalls, b) a buoyant gate horizontally disposed between said sidewalls below said deck of the unit in a plane oriented from substantially horizontal to less than vertical in absence of a self-actuating force, said gate having an upper surface, lateral sides, and front and rear ends, the rear end of each gate being pivotally mounted about a horizontal axis transverse to said sidewalls by one or more pivotation members, each said pivotation member comprising a stationary member on a support connected to said frame and a moveable member moveably joined to said stationary member for pivotation of the gate rotationally upwardly about said horizontal axis between said sidewalls for engagement with said deck on rise of water buoyantly lifting the gate, said gate having sealing lip gaskets arranged on the lateral sides and front end of the gate to sealingly wipe respectively said sidewalls and said deck on rise of said gate, and c) a limiter for limiting an extent of self-actuated rotation of said gate, the gate of each of said plurality of units except the vertically lowermost unit being vertically spaced at said rear end from the rear end of the gate of a next lower unit by at least a sum of a vertical thickness dimension of said deck and a vertical height of maximum rise of the gate of such next lower unit about the horizontal axis on which said next lower unit can rotate upwardly.

19. The method of claim 18 in which said flood prevention units are vertically stacked one over another inside said sidewalls in an alignment such that an uppermost unit is and any intermediate units are entirely over a lowermost unit and wherein said frame further comprises a plurality of trays, one for each unit, under the gate of the unit, and, except for the lowermost unit, above the deck of the next lower unit of the assembly, said tray comprising a horizontal floor and upright front and back plates rising from the floor.

20. A self-actuating flood barrier assembly responsive to rising water for preventing entrance of flood waters though a horizontal opening in an upright wall of a structure, comprising:

a) a frame comprising a first upright sidewall, a second upright sidewall for mounting adjacent opposite sides of said opening to project transversely outwardly from said wall, b) a plurality of flood prevention units vertically stacked one over another inside said sidewalls in an alignment such that an uppermost unit is and any intermediate units are entirely over a lowermost unit, each unit comprising:

i) a deck horizontally connecting said sidewalls, ii) a buoyant gate horizontally disposed between said sidewalls below a said deck of the unit and in a plane oriented from substantially horizontal to less than vertical in absence of a self-actuating force, such gate having an upper surface, lateral sides, and front and rear ends, the rear end of each gate being pivotally mounted about a horizontal axis transverse to said sidewalls by one or more pivotation members, each said pivotation member comprising a stationary member on a support connected to said frame and a moveable member moveably joined to said stationary member for pivotation of the gate rotationally upwardly about said horizontal axis between said sidewalls for engagement with said deck on rise of water buoyantly lifting the gate, iii) a sealing gasket arranged on the front end of the gate to sealingly wipe said deck on rise of said gate, (iv) under each gate of a unit and, except for the lowermost unit, above the deck of the next lower unit of the assembly, a plurality of trays comprising a horizontal floor connecting said sidewalls and upright front and back plates rising from the floor, and v) a limiter for limiting an extent of self actuated rotation of said gate, wherein maximum rise of the gate is vertical or within a predetermined range of degrees from vertical, the gate of each of said plurality of units except the vertically lowermost unit being vertically spaced at said rear end from the rear end of the gate of a next lower unit by at least a sum of a vertical dimension thickness of the deck and a vertical height of maximum rise of the gate of said next lower unit about the horizontal axis on which said next lower unit can rotate upwardly.

* * * * *